US011077970B2

(12) United States Patent
Peccetti

(10) Patent No.: US 11,077,970 B2
(45) Date of Patent: Aug. 3, 2021

(54) PACKAGING WITH EXTENDABLE PLASTIC FILM WITH SIMPLIFIED GRIPPING

(71) Applicant: Colines S.p.A., Novara (IT)

(72) Inventor: Francesco Peccetti, Sizzano (IT)

( * ) Notice: Subject to any disclaimer, the term of this patent is extended or adjusted under 35 U.S.C. 154(b) by 71 days.

(21) Appl. No.: 16/496,272

(22) PCT Filed: Mar. 21, 2018

(86) PCT No.: PCT/EP2018/057177
§ 371 (c)(1),
(2) Date: Sep. 20, 2019

(87) PCT Pub. No.: WO2018/177844
PCT Pub. Date: Oct. 4, 2018

(65) Prior Publication Data

US 2020/0047961 A1 Feb. 13, 2020

(30) Foreign Application Priority Data

Mar. 30, 2017 (IT) ..... 102017000034957

(51) Int. Cl.

| | |
|---|---|
| ***B65D 71/06*** | (2006.01) |
| ***B65B 27/04*** | (2006.01) |
| ***B65B 61/16*** | (2006.01) |
| *B65B 59/00* | (2006.01) |

(52) U.S. Cl.
CPC ..... *B65B 27/04* (2013.01); *B65B 61/16* (2013.01); *B65D 71/063* (2013.01); *B65B 59/001* (2019.05); *B65B 59/003* (2019.05); *B65D 2571/0045* (2013.01)

(58) Field of Classification Search
CPC ..... B65D 71/06; B65D 71/063; B65D 71/08; B65D 2571/0045; B65D 75/56
USPC ..... 206/427, 432
See application file for complete search history.

(56) References Cited

U.S. PATENT DOCUMENTS

| | | | | |
|---|---|---|---|---|
| 4,130,201 | A | 12/1978 | Duerr | |
| 4,333,570 | A * | 6/1982 | Heider | B65D 71/10 206/432 |
| 5,201,463 | A * | 4/1993 | George | B65D 5/4204 206/432 |
| 8,267,248 | B2 * | 9/2012 | Kollmuss | B65B 11/06 206/432 |
| 8,333,054 | B2 * | 12/2012 | Hartl | B65D 71/08 53/413 |
| 8,424,272 | B2 * | 4/2013 | Cerf | B65B 61/14 53/413 |
| 10,351,284 | B2 * | 7/2019 | Niedersuess | B65B 27/04 |
| 10,435,216 | B2 * | 10/2019 | Kannengiesser | B65D 71/10 |
| 10,597,181 | B2 * | 3/2020 | Cattaneo | B65B 11/008 |

(Continued)

FOREIGN PATENT DOCUMENTS

| | | | | |
|---|---|---|---|---|
| EP | 0442111 A2 * | 8/1991 | | B65B 9/026 |
| EP | 2402263 A2 * | 1/2012 | | B65D 71/10 |

(Continued)

*Primary Examiner* — Bryon P Gehman
(74) *Attorney, Agent, or Firm* — Themis Law

(57) ABSTRACT

A packaging adapted to contain products, which is made with an extendable plastic film and has a simplified gripping, and in which the extendable plastic film is wrapped around the products with at least one coil to form a bundle, has on its upper surface only one notch configured to provide a gripping point of the packaging for a user.

9 Claims, 6 Drawing Sheets

(56) References Cited

U.S. PATENT DOCUMENTS

| | | | | |
|---|---|---|---|---|
| 10,730,654 | B2 * | 8/2020 | Kannengiesser .... | B65D 71/063 |
| 2007/0215505 | A1 | 9/2007 | Walker | |
| 2009/0266732 | A1 | 10/2009 | Hartl | |

FOREIGN PATENT DOCUMENTS

| | | |
|---|---|---|
| GB | 1564772 | 4/1980 |
| WO | 2009091318 | 8/2006 |
| WO | 2016102581 | 6/2016 |

* cited by examiner

PACKAGING WITH EXTENDABLE PLASTIC FILM WITH SIMPLIFIED GRIPPING

The present invention relates to a packaging with extendable plastic film with simplified gripping.

The production of so-called "bundles", i.e. packagings of containers, such as bottles, for example, is already known in the packaging field. Said bottles are usually coupled in pairs to make a unitary and compact package of a set of bottles, formed by a thin film of plastic material.

This packaging is effected in automatic machines, called bundling machines, in which the groups of paired bottles are wrapped in this film. The final product is particularly used, for example, in the large-scale distribution sector in the beverage field. This type of bundle, in fact, is transparent, light and the film of which it is composed can be rapidly applied. It is normally suitable for containing six bottles made of plastic material, containing mineral water or other beverages. The reference to the aforementioned bundle of bottles is provided as an example, but it is understood that this bundle can also apply to the packaging of other groups of objects.

It is also known that in the field of packaging with film made of plastic material, heat-shrinkable plastic material is widely used. In this case, film made of heat-shrinkable plastic material is wrapped around the above-mentioned group of containers, such as, for example, six bottles, flanked so as to form three rows on two parallel lines. This wrapped group is then treated with shrinking inside an oven, causing shrinkage of the film and creating a compact and stable bundle.

The two steps for producing the finished bundle described above involve a high cost of the bundle in heat-shrinkable plastic material.

Alternatively, in order to lower the costs, a solution has been proposed using film made of extendable plastic material for producing the packaging. This type of extendable film does not require heat-shrinkage, with a lowering of the costs.

Said bundle, for example, is produced by moving the group of bottles, such as six bottles, slightly spaced apart, forwards along a feeding line. Wrapping is effected on this line, in a film of extendable plastic material in a continuous spiral form around each of the advancing groups. Said wrapping is subsequently separated into a single packaging by cutting.

Said bundle is economical as it is simple to produce with little material and with rapid processing.

In any case, at present, whichever of the two techniques is used, the bundle is then completed with possible graphic indications, gripping elements or handles and possible rapid opening means.

In the present case, with respect to said gripping elements or handles, the bundles are currently provided with a handle or grip which facilitates the user's hold. This facilitates the gripping and transporting of the bundle.

Examples of this solution are those described and disclosed in EP178142, EP442111 or U.S. Pat. No. 5,570,787.

It can therefore be noted that there are numerous solutions with gripping elements or handles made with an additional element variably associated with the bundle, by crimping, gluing or welding.

This type of application or provision also weighs heavily on the final costs of the finished bundle.

Furthermore, it has been noted that these solutions more or less adapt to bundles produced with extendable film which, due to their elasticity, tend to extend in the points of application.

Also in this case, moreover, the adoption of gripping elements leads to the use of specific positioning devices for the gripping element downstream of the packaging line.

A general objective of the present invention is therefore to provide a packaging with extendable plastic film with simplified gripping capable of solving the above-mentioned drawbacks of the known art, in an extremely simple, economical and particularly functional manner.

A further objective of the present invention is to provide a packaging with extendable plastic film with simplified gripping which, in its simplicity, in any case entails an easy and safe use.

Another objective of the present invention is to provide a packaging with extendable plastic film with simplified gripping having a good appearance and which does not require additional particular equipment in addition to the packaging line.

The above objectives are achieved by a packaging with extendable plastic film with simplified gripping according to the independent claim 1 and the following subordinate claims.

It can therefore be seen that, according to the invention, a bundle structure of extendable plastic film is provided, as a whole extremely economical, having an effective and optimal gripping point for carrying the bundle.

It should also be noted that the extendable plastic material offers significant savings in the production of the packaging. Furthermore, this material is not affected by the creation of notches and therefore optimally lends itself to defining very simple and practical gripping points.

The fact of effecting two opposing turns of extendable film on bottles allows a notch or slit to be produced very simply without affecting the entire package.

The structural and functional characteristics of the present invention and its advantages with respect to the known art will appear more evident from the following description referring to the enclosed schematic drawings, which show an embodiment of the present invention. In the drawings.

Figure 1:
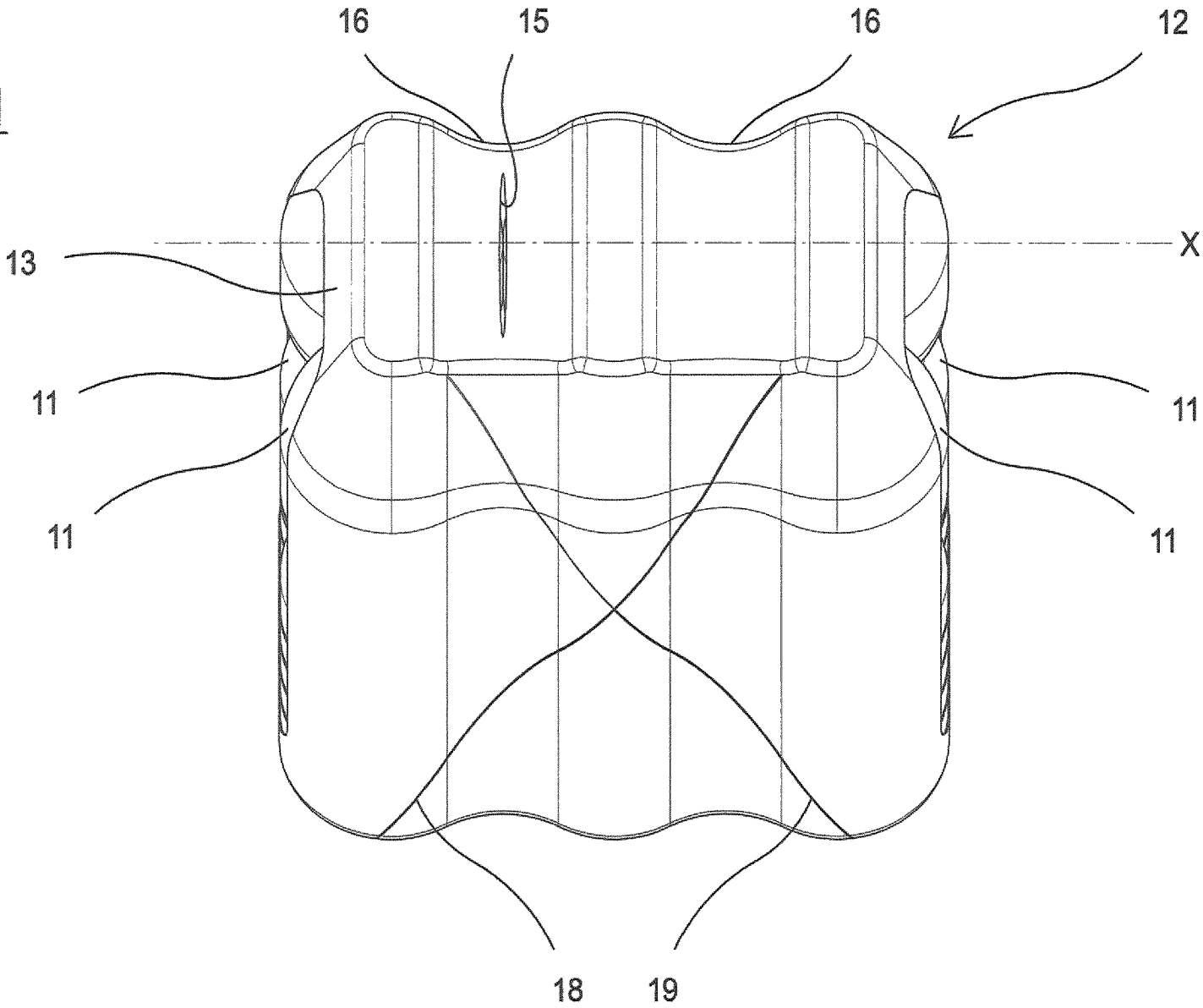
FIGS. 1 and 2 are perspective views of a packaging of the invention in a first embodiment.

With reference to the figures in general, a packaging with extendable plastic film 12 is produced in machines such as those described and illustrated in Italian patent applications Nr. 102016000012911 and 102016000013038 of the same Applicant.

In these machines, a packaging method in extendable film is effected, of groups of products, such as bottles 11, advancing in pairs of products. This method generally comprises the following steps:

ordering products or groups of products 11;

feeding and passing products or groups of products thus ordered into winding units of extendable film and wrapping them in the form of a continuous coil or in the form of two continuous coils, crossed and overlapping to form a packaging;

advancing and feeding said packaging to a cutting unit which cuts said packaging transversely into packagings 12 of groups of products.

The groups of products can be packaged separately from each other or they are separated only once the packaging has been cut.

Downstream of these general steps, a step is effected according to the invention, wherein only one notch is produced on the upper surface of the single packaging, suitable for creating a gripping point of the packaging for the user.

In this way, a packaging is produced with extendable plastic film with simplified gripping 12, containing products 11, wherein the film 13 is wrapped around products 11 with a single turn or crossed turns according to the directions 18, 19.

It should be noted how a packaging is produced with one or more layers of film made of extendable plastic material applied by stretching the extendable plastic material around the containers.

In this kind of packaging 12, according to the invention, only one notch is present in its upper surface 14, suitable for creating a gripping point of the packaging for the user.

Figure 2:
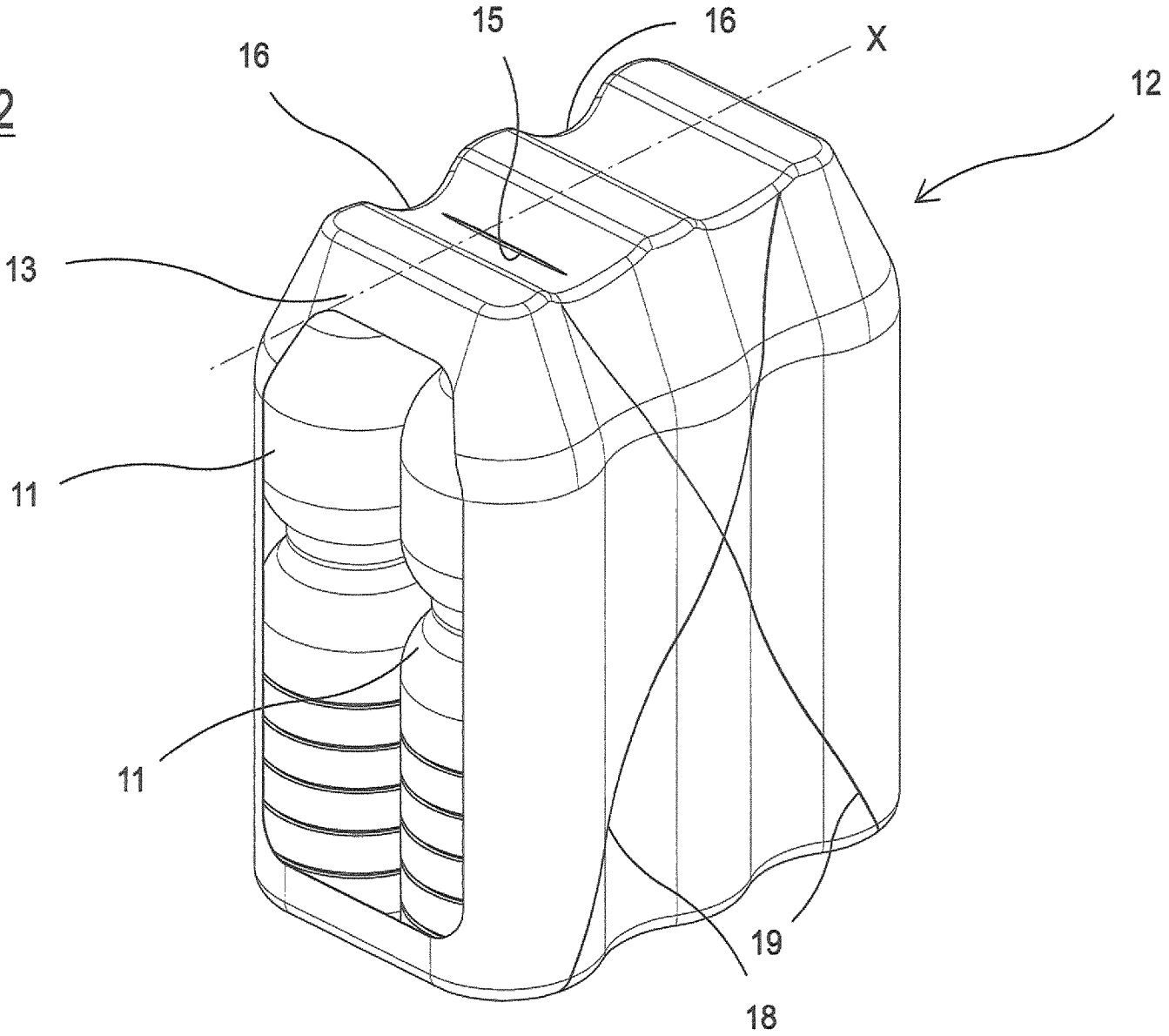

This notch 15 is advantageously produced transversally, according to a direction perpendicular to a winding axis X of the single coil or crossed coils in an area between two pairs of rows of bottles 11. In general, this transversal notch area is positioned in a central recessed area 16 of the packaging or bundle as shown in FIGS. 1 and 2.

In an equally advantageous alternative arrangement, a notch 15' is produced according to a transversal direction with respect to the winding axis of the single coil or crossed coils in an area between two adjacent bottles in a central portion of the packaging.

Figure 3:
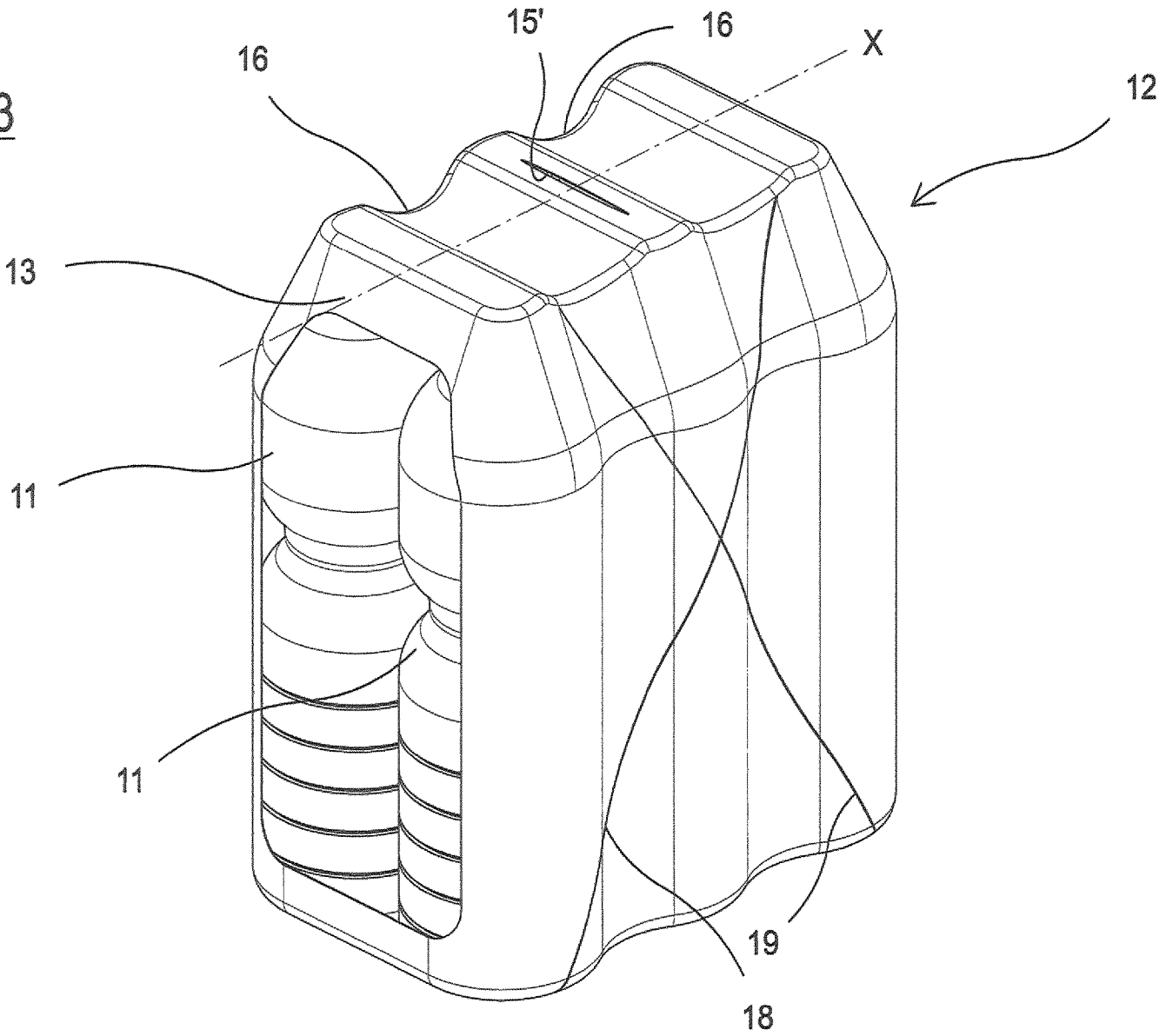
FIG. 3 is a perspective view of a packaging of the invention in a second embodiment.

In general, this area of the transversal notch is defined by a high area between two subsequent recesses in an intermediate portion of the upper surface of the packaging or bundle as shown in FIG. 3.

Figure 4:
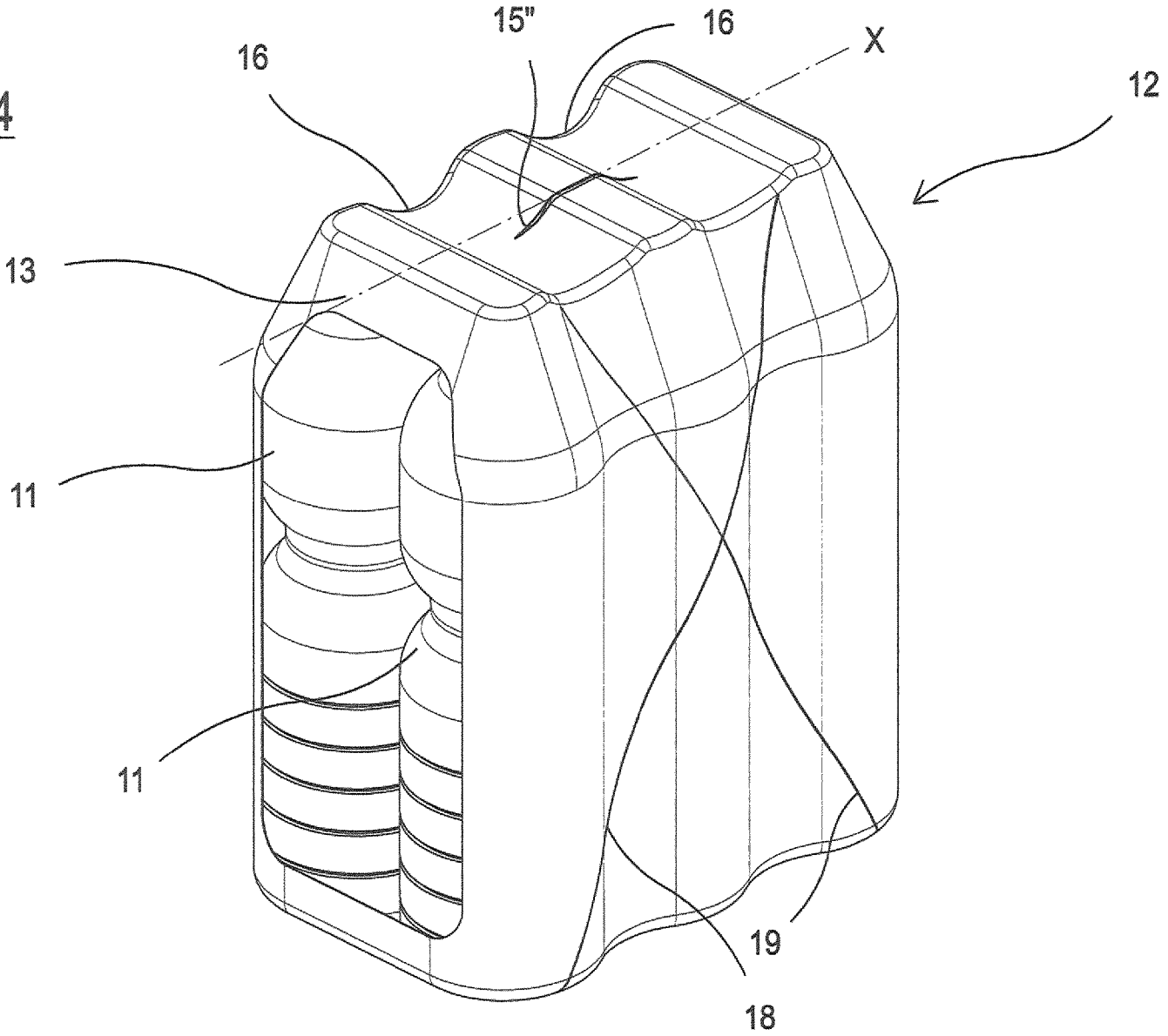
FIG. 4 is a perspective view of a packaging of the invention in a third embodiment.

In an equally advantageous alternative arrangement, a notch 15" is produced in a longitudinal direction, parallel to the winding axis of the single coil or crossed coils, in an area between the two rows of bottles in a portion between two end bottles 11, as shown in FIG. 4.

It should also be noted that this notch 15, 15', 15" in the wrapping coil or coils 18, 19 of the packaging, causes a withdrawal of the extendable wrapping film.

In this way, the notch does not cause an extension of the incision that produces the notch. The notch actually causes the formation of an edge portion of the notch having a considerable resistance which is such as to allow the bundle to be grasped and lifted without any danger of breakage.

It can be observed, in fact, that the elastic return forces of the extendable material by its very nature, cause a thickening or curling of the material along the periphery of the notch.

Figure 5:
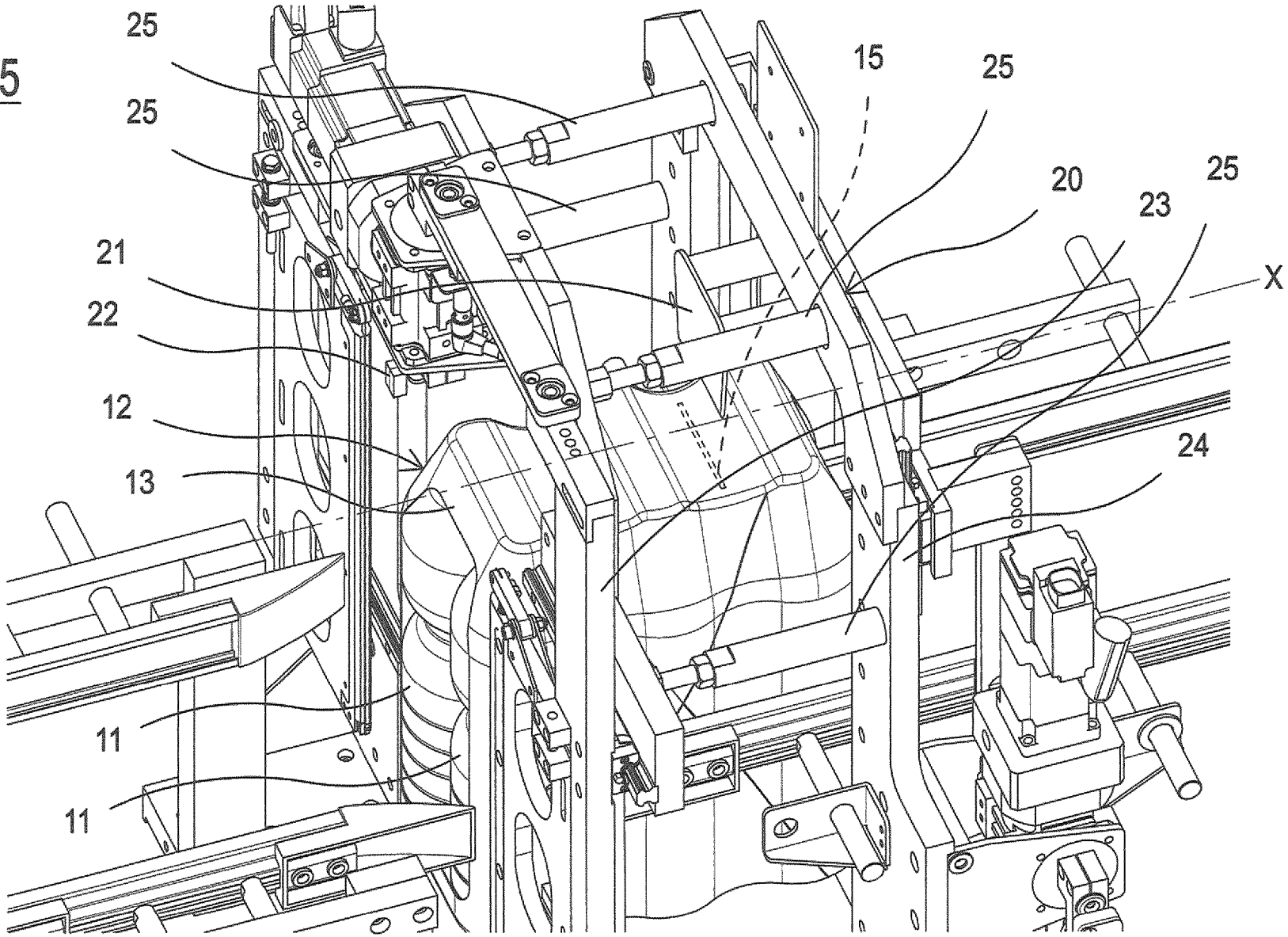
FIGS. 5 and 6 show, in a perspective view, a cross-section of an automatic bundling machine provided with a device suitable for producing a gripping notch in a packaging of bottles.
Figure 6:
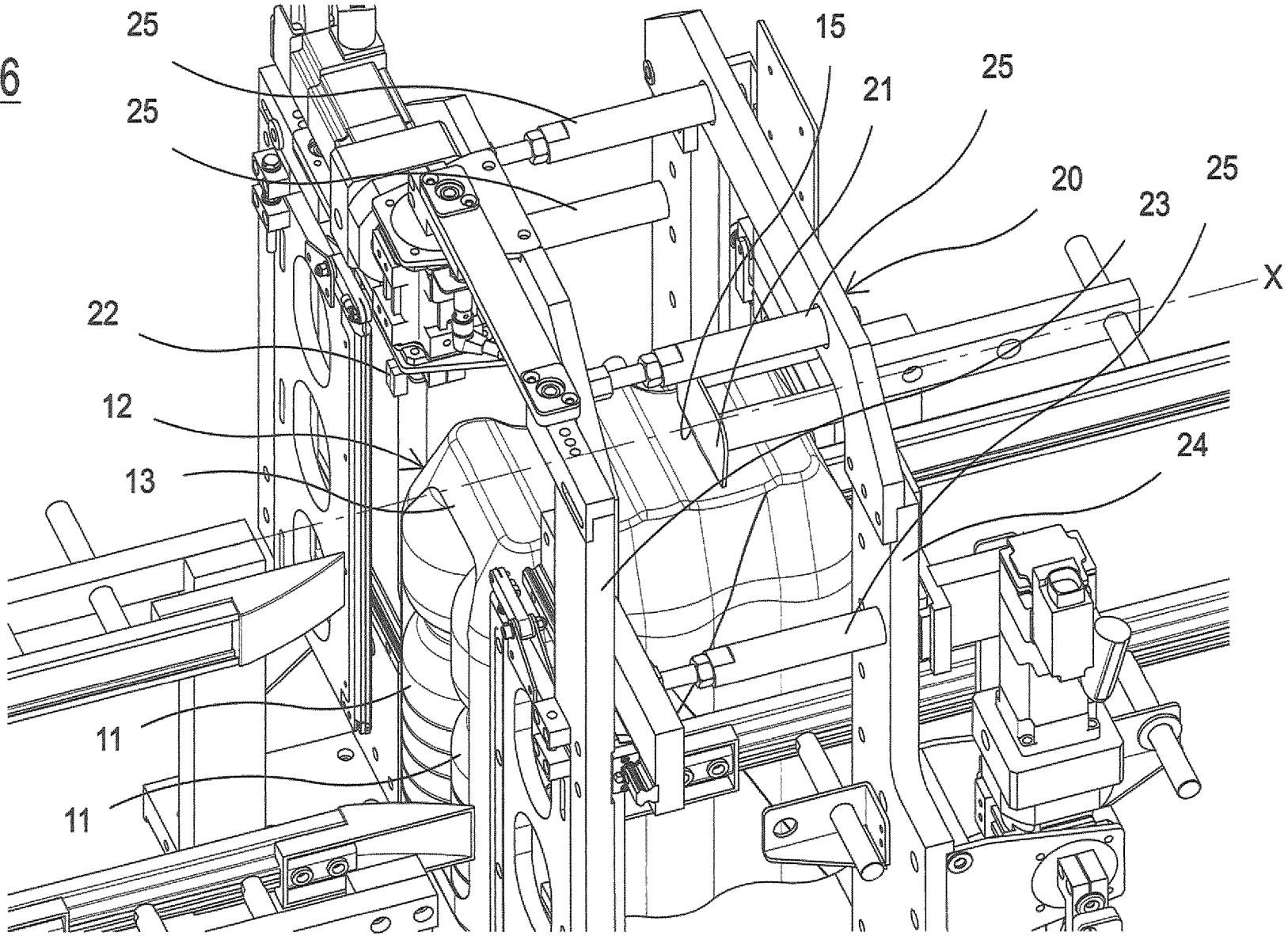

FIGS. 5 and 6 show a cross-section of an automatic bundling machine provided with a device suitable for producing the gripping notch described above.

In particular, a straddle frame 20 is illustrated, beneath which a packaging 12 passes, completely wrapped in extendable film 13, positioned on a conveyor belt or similar device (not shown).

The straddle frame 20 carries a vertical blade 21 movable in lifting and lowering with respect to the packaging 12 by means of an actuator such as a cylinder.

This movement causes the blade 21 to produce the notch 15 shown in FIGS. 1 and 2. FIG. 5, in fact, shows the raised position of the blade 21 with respect to the underlying packaging 12. FIG. 6 shows the blade 21 which has penetrated and cut the packaging 12 to form the packaging of FIGS. 1 and 2.

The correct positioning of the packaging 12 with respect to the blade 21 is effected by means of sensors, schematized in FIG. 22, which detect the position of the packaging. It can also be observed how the frame 20 provides two crossbars 23, 24 spaced from each other by means of tie-rods 25. The tie-rods 25 can be extended and/or shortened so as to vary the position of the blade 21 with respect to the packaging 12 also in relation to the fact that said packaging can have a variable overall dimension in relation to the type and number of bottles contained therein, etc.

The forms of the structure for producing a packaging with extendable plastic film with simplified gripping of the invention, as also the materials and assembly modes indicated, can obviously differ from those shown purely as a non-limiting example in the drawings.

The objective mentioned in the preamble of the description has therefore been achieved.

The protection scope of the present invention is defined by the enclosed claims.

The invention claimed is:

1. A packaging with extendable plastic film with simplified gripping, adapted to contain products, comprising:

the extendable plastic film, wrapped around products with at least one coil to form a bundle, wherein said packaging has, on its upper surface, only one notch configured to create a gripping point of the packaging for a user, and wherein said extendable plastic film is wound around said products in crisscross coils.

2. The packaging according to claim 1, wherein said notch is produced transversally, according to a direction perpendicular to a winding axis of the at least one coil in an area between two rows of adjacent products.

3. The packaging according to claim 2, wherein said area between the two rows of adjacent products is defined in a central recessed area of the packaging.

4. The packaging according to claim 1, wherein said notch is produced along a longitudinal direction parallel to a winding axis of the at least one coil in an area between two rows of adjacent products in a central portion of the packaging.

5. The packaging according to claim 4, wherein said area between the two rows of adjacent products in the central portion of the packaging is defined by a recessed area in an intermediate part of an upper surface of the packaging.

6. The packaging according to claim 1, wherein said notch is produced along a transversal direction with respect to a winding axis of the at least one coil in an area between two products in a portion between two subsequent recesses.

7. The packaging according to claim 1, wherein said extendable plastic film forms a bundle applied by stretching said extendable plastic film around the products.

8. The packaging according to claim 1, wherein said products are bottles.

9. The packaging according to claim 8, wherein there are six bottles in two adjacent rows.

* * * * *